United States Patent [19]

Knelson

[11] Patent Number: 4,776,833

[45] Date of Patent: Oct. 11, 1988

[54] CENTRIFUGAL SEPARATOR

[76] Inventor: Benjamin V. Knelson, 20313-8th Avenue, R.R. #11, Langley, B.C.,, Canada, V3A 6Y3

[21] Appl. No.: 922,401

[22] Filed: Oct. 23, 1986

Related U.S. Application Data

[63] Continuation-in-part of Ser. No. 843,192, Mar. 24, 1986, abandoned.

[51] Int. Cl.[4] ..... B04B 11/00

[52] U.S. Cl. ..... 494/27; 494/36; 494/45; 494/81

[58] Field of Search ..... 494/43, 67, 68, 27, 494/28, 29, 85, 36, 81, 45, 56, 57, 58, 59; 210/360.1, 360.2, 381, 382, 369, 378

[56] References Cited

U.S. PATENT DOCUMENTS

| | | | |
|---|---|---|---|
| 1,853,249 | 4/1932 | Ainlay | 494/45 |
| 2,179,807 | 11/1939 | Asmussen | 494/45 |
| 2,272,675 | 2/1942 | Knudsen | 494/45 |
| 4,608,040 | 8/1986 | Knelson | 494/27 |

FOREIGN PATENT DOCUMENTS 22055 4/1935 Australia .

*Primary Examiner*—Robert W. Jenkins

*Attorney, Agent, or Firm*—Adrian D. Battison; Stanley G. Ade

[57] ABSTRACT

A centrifugal separator for use for example with the extraction of gold of the type comprising a bowl with a plurality of rings on the inner peripheral surface between which are provided openings for the injection of water between the rings into the interior of the bowl is modified by a number of further features. Thus firstly the rings and recesses between the rings are molded from a plastics inner which is cast in place within an outer rigid bowl. The openings are formed by punched depressions in the outer wall formed prior to the casting and then drilled subsequent to the casting to form a tangential opening. The shape of the recesses defines sides tapered outwardly toward a flat base at a shallow angle of the order of 15 degrees with the width of the base wider than the width of the injection openings.

15 Claims, 1 Drawing Sheet

121
122
124
125
131
132
94
60
91
19
90
97
97
20
201
202
96
92
39
93
38
72
70
73
11
39
13
9
35
134
122
12
133
130
126
128
127
18
16
71
8
14
21
123
36
95
98
94
121
15
37
39
38
38
19
10

CENTRIFUGAL SEPARATOR

This application is a continuation-in-part of my application No. 843,192 filed Mar. 24, 1986 which is now abandoned.

This invention relates to a centrifugal separator of the type which can be used to extract heavy metals such as gold from a slurry containing the metal mixed with other materials.

My issued U.S. Pat. No. 4,608,040 discloses a device of this type which comprises a centrifuge bowl having a base and a peripheral wall surrounding an axis passing through the base and generally upstanding from the base to an open mouth, a plurality of axially spaced inwardly projecting rings mounted on an inner surface of the peripheral wall and a plurality of openings extending through the peripheral wall from the outer surface to the inner surface thereof, the openings being arranged between each ring and the next adjacent ring and in spaced relation around the peripheral wall, means mounting the bowl for rotation about the axis, means for feeding the materials into the bowl so that during rotation of the bowl they flow over the peripheral wall for discharge from the open mouth and means for applying fluid to the outer surface of the bowl so as to pass through the openings and fluidize the materials between the rings.

This device has been found to operate very satisfactorily and in a considerably improved manner relative to prior art devices. Such prior art devices are shown for example in my Canadian Patent No. 111809 in old Australian Patent Nos. 22055/35 and 17487/34 (MacNicol).

However, there remains opportunity for further improvement in separation efficiency and in construction of the bowl which enables improved wear characteristics and the improved efficiency.

The present invention provides a number of improvements over my above described device which can improve wear resistance and separation efficiency.

According to a first aspect of the invention, therefore, there is provided apparatus for centrifugally separating intermixed materials of different specific gravities comprising a centrifuge bowl having a base and a peripheral wall surrounding an axis passing through the base and generally upstanding from the base to an open mouth, axially spaced inwardly projecting peripherally extending members defined on an inner surface of the peripheral wall so as to provide a peripherally extending recess between each member and the next adjacent member, and a plurality of openings extending through the peripheral wall from an outer surface to the inner surface thereof, the openings being arranged in the recess between each member and the next adjacent member and in spaced relation around the peripheral wall, means mounting the bowl for rotation about the axis, means for feeding materials into the bowl such that during rotation of the bowl they flow over the peripheral wall for discharge from the open mouth, and means for applying fluid to the outer surface of the bowl so as to pass through the openings and fluidize the materials in the recesses, each recess being shaped in cross section to define a pair of sidewalls extending generally outwardly from said axis and converging toward an imaginary apex, and a base wall transverse to and interconnecting the sidewalls through which said openings extend, the angle subtended between the sidewalls at the apex being less than 45° and the dimension of the base wall from one sidewall to the other of the sidewalls is greater than the diameter of the openings and greater than ¼ inch.

Thus the rings or members defining the channels are tapered so that the channels are of v-shape narrowing toward a flat base thereof at the outer wall of the bowl with the inlet openings arranged at the base and directed tangentially along the channels. This v-shape combined preferably with the tangential direction of the fluid inlet acts to improve the formation of a fluidized bed of the material within the channel and helps to avoid pockets of stationary or solid material which reduce separation efficiency.

In addition, the v-shape of the channels allows them to be more quickly and more effectively washed in the clean out process at the end of a batch when the concentrate is collected and also reduces the volume of the concentrate thus improving the separation efficiency.

Preferably the depth of the v-shaped channel is greater than the width thereof at the upper edge and the width of the base is approximately half the width thereof at the upper edge. This provides an angle of taper between the sides which is less than 45 degrees and preferably of the order of 30 degrees.

This arrangement of separation channel can preferably be manufactured by a cast polyurethane bowl which can be carried within an outer shell of a rigid material of sufficient strength to withstand the centrifugal forces involved.

According to a second aspect of the invention there is provided apparatus for centrifugally separating intermixed materials of different specific gravities comprising a centrifuge bowl having a base and a peripheral wall surrounding an axis passing through the base and generally upstanding from the base to an open mouth, and axially spaced inwardly projecting peripherally extending members defined on an inner surface of the peripheral wall so as to provide a peripherally extending recess between each member and the next adjacent member, means mounting the bowl for rotation about the axis, means for feeding materials into the bowl such that during rotation of the bowl they flow over the peripheral wall for discharge from the open mouth, said bowl comprising an outer rigid metal support layer having an inner surface which is free from said members and recesses and a cast plastics inner layer having an outer surface lying in contact with and substantially following the shape of the inner surface of the support layer and an inner surface defining said members and recesses whereby the members and recesses are formed wholly in and by the plastics material.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DETAILED DESCRIPTION

Figures 1, 2:
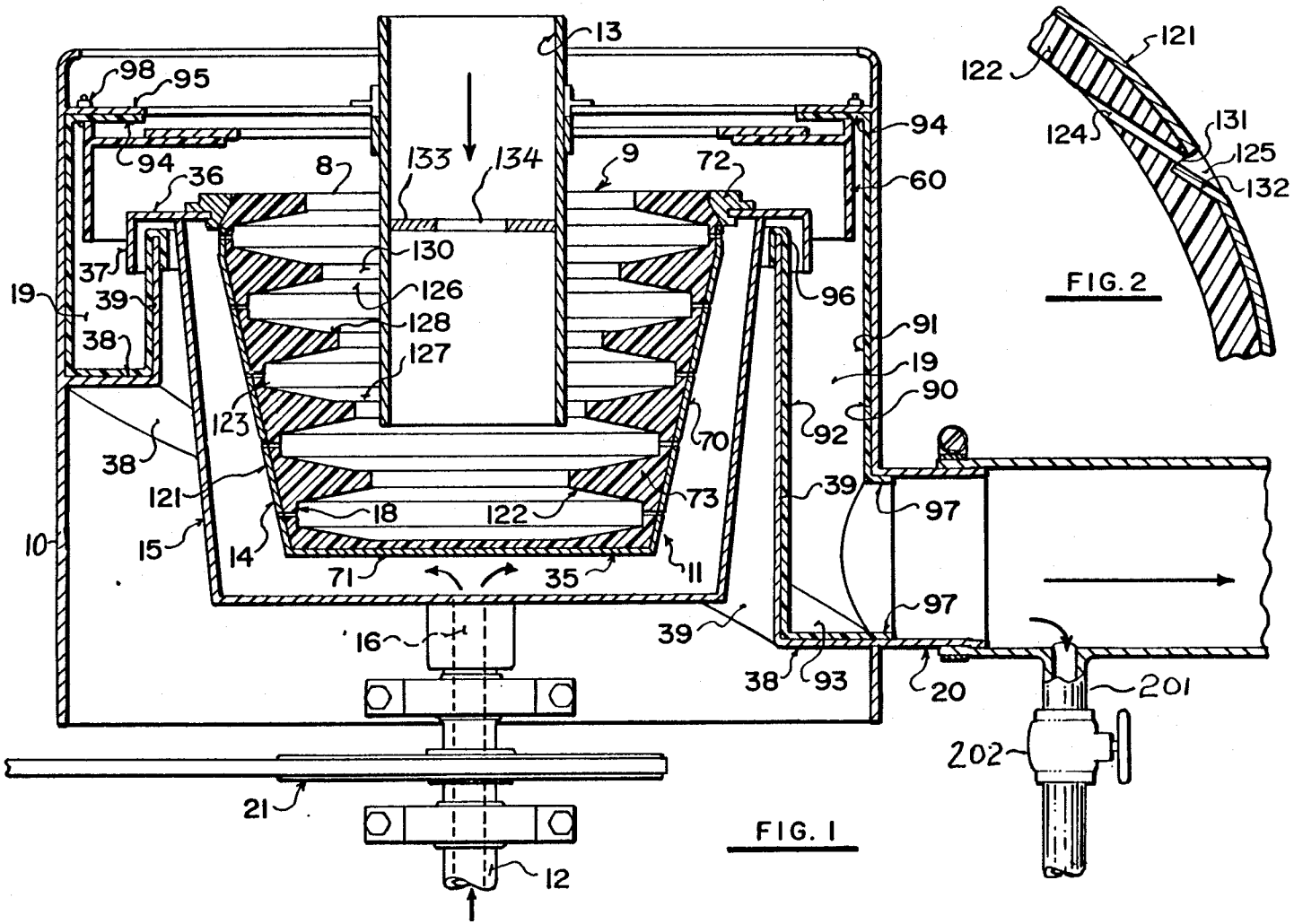
FIG. 1 is a vertical cross sectional view of a bowl and outer casing of a separation device according to the invention.
FIG. 2 is a part cross sectional view of the bowl of FIG. 1 showing a portion of the wall and particularly an inlet opening through the wall.

Turning firstly to FIG. 1, the basic construction of this arrangement is described in detail in my U.S. Pat. No. 4,608,040 issued Aug. 26, 1986 to which reference should be made for any detail of the device omitted from this description. For convenience some of the important features will be described here.

Thus the apparatus comprises generally a bowl 11 which has a base 35, a peripheral wall 14 and an open upper mouth 9. The bowl is mounted on a shaft 12 for rotation about its axis and is surrounded by an outer casing 15 defining a jacket or enclosure around the bowl to which liquid may be supplied by a duct 16 through the shaft 12.

Feed material can be deposited into the bowl through a supply duct 13 depending downwardly through the open mouth. On the inner surface of the peripheral wall of the bowl is provided a plurality of inwardly projecting rings 8 which define annular channels or recesses between the rings in which a fluidized bed is defined by a plurality of fluid inlet openings which allow material to enter from the jacket 15 into the bowl through the base 18 of each of the channels. This defines a fluidized bed within the channels between the rings 8 which acts to separate heavier material which collects in the channels from lighter material which tends to flow out over the mouth of the bowl with the fluid into an outlet duct 19, 20.

After completion of a batch of the material, a plug (not shown) can be pulled at the bottom of the bowl from a duct and the material collected in the channels washed from the bowl for collection for final separation of the required heavy metal.

The bowl 11 is mounted in the housing 10 which defines an outer surface for the channel 19. An inner circumferential surface for the channel 19 is defined by a cylindrical wall 39 inside the housing 10 so as to form the channel 19 as an annular channel surrounding the bowl.

To assist in communication of the discharge material from the mouth of the bowl to the discharge duct 20, an inclined surface 38 is arranged around a lower end of the annular channel 19. A flange 37 carried around the periphery of the outer bowl 15 on a radial support surface 36 cooperates with the annular wall 39 to prevent material entering the area beneath the bowl 15 and confining the material to enter the channel 19. A guide 60 formed of plastics material acts to change the direction of the direction of the material as it exits from the bowl so that it can properly enter the channel 19.

The bowl is driven in rotation by a pulley 21 on the shaft 12 which is in turn rotated by a drive motor schematically indicated at 22.

The above described features are common to my aforementioned U.S. Patent. The modifications according to the present invention will now be described in conjunction with the drawings.

Firstly, the bowl shown in FIG. 1 is different from the bowl of my earlier patent in that the bowl is in this embodiment manufactured in the form of an outer smooth wall steel shell 121 and an inner cast polyurethane drum forming the channels and rings 12. The drum is generally indicated at 122.

Furthermore in this case the rings instead of being merely flat plates lying in a plane at right angles to the axis are formed by tapered portions which define the channels or recesses as having tapered sides 126, 127 converging to a flat transverse base 123. The depth of the channel is of the order of 1½ to 2 times the width thereof at its open mouth and the base is of the order of half the width of the open mouth. This defines an angle of taper of the order of 15 degrees that is an angle between the sides of the order of 30 degrees. Such an angle is certainly less than 45 degrees and which has been found to provide the required conditions for the most effective fluidized bed. More specifically, the increased effect of the injected water at the narrower base acts to counter the increased centrifugal and compression forces at the base so as to avoid packing of the material. At the same time, the angle of taper is significantly less than 45 degrees since an angle greater that that comes closer to the flat cylindrical surface on which the compression forces are significantly increased and the separation efficiency very much reduced.

The flat base 123 defines effectively a cylindrical surface surrounding the axis of the bowl with each base being positioned slightly outwardly of the next adjacent base in accordance with the increase in diameter of the outer layer 121. Each of the sides 126, 127 is inclined relative to the base at substantially the same angle on opposed sides thereof and extends effectively out to the same dimension. However the side 127 includes a radial portion 128 extending outwardly beyond the extent of the side 127. The inner most extent of the portion 128 is connected to the next adjacent side 126 by a cylindrical surface portion 130 surrounding the axis.

Turning therefore to FIG. 2, there is shown a cross section through the outer shell 121 and the inner drum 122 lying in a radial plane and at one of the inlet openings which communicates water or fluid from the jacket 17 into the drum at the bases of the channels. The inlet is indicated at 124 and comprises a punched depression 125 in the steel bowl or liner 121 following which a hole is drilled from the punched depression 125 through the polyurethane layer 122 at the base 123 of the polyurethane drum. Thus as shown in FIG. 2, the opening through the base of the channel is, as far as practically possible, tangential to the channel as opposed to the conventional radial inlets.

The bowl is manufactured by initially rolling and subsequently punching the outer surface to form the rigid steel outer bowl. Thus the depressions 125 are punched into the inside direction forming a substantially radial end face 131 and a tapering surface 132. Subsequently a mold defining the inner surface of the bowl is inserted into the outer layer 121 and a suitable plastics material for example polyurethane injected into the space between the bowl 121 and the mold (not shown). This forms the shape of the rings and recesses in the plastics material which subsequently sets and is permanently attached to the shell 121 by the natural bonding effect and by the punched depressions 125.

The whole, therefore, of the internal shape defined by the rings and recesses is formed in the plastics material with the inner surface of the shell 121 being effectively smooth except, of course, for the depressions 125.

Subsequent to the casting process, the depressions 125 are drilled from a position exteriorly of the shell 121 through the substantially radial face 131 in substantially the tangential direction as indicated at 124.

The diameter of the drilled holes is chosen to be sufficient to allow the introduction of required quantity of water as can be calculated or determined readily by experimentation. In one example the diameter is ¼ inch.

The width of the base 123 from one sidewall to the opposite sidewall is arranged to be significantly greater than the width of the openings 124. Thus a flat side is formed on either side of the openings and in one example the width of the base is of the order of three times the diameter of the openings. This arrangement, in conjunction with the effectively tangential direction of the openings has been found to provide the required fluidization of the bed of material in the recesses.

Reverting now to FIG. 1, there is shown a further modification of the device of my above U.S. Patent. In this modification a molded polyurethane insert 90 is applied to the area of the launder or discharge channel 39. The insert 90 is molded as an integral one-piece unit defined by an outer wall 91, an inner wall 92 and a base 93 all of which co-operate to define an annular channel of identical shape to the annular channel 39 and its base 38.

The upper edge of the outer wall 91 includes an inturned flange 94 extending at right angles to the wall and thus forming an annular attachment flange by which the insert can be bolted to an upper wall 95 of the housing. The construction of this upper wall is described in more detail in my aforementioned patent.

The upper edge of the inner wall 92 includes a turned over flange 96 which extends downwardly parallel to the inner wall and spaced therefrom by a distance substantially equal to the thickness of the metal of which the housing is generally formed. Thus the flange 96 forms a U-shaped clip over the upper edge of the wall 39 of the metal channel. At the duct 20, the outer wall 91 has a circular flange formed as indicated at 97 so that the flange or lip extends into the initial part of the duct 20.

In manufacture of the device, prior to assembly of the upper part of the housing, the integrally molded insert 90 is applied into the channel 39 with the lip 96 applied over the upper edge of the wall 39. The insert is therefore a separate item from the metal wall and has a thickness of the order of ¼" which makes the insert substantially self-supporting. After the bowl is inserted so the lip 37 overhangs the inner wall 92, the upper part of the housing is applied to clamp the insert into place by the attachment by bolts 98 to the upper wall 95.

The use of an integral molded insert has prevented serious wear in the area of the launder or outlet channel. The use of the integral molding prevents any of the material in suspension from collecting behind the plastics insert which could otherwise occur with various curtains and the like since the material has a great tendency for collection in such areas and when doing so generates a projection in the curtain or the like which can interrupt the flow of the material in its intended direction.

In addition in FIG. 1 there is shown a duct 201 which taps off from the side of the outlet duct 20 a sample of the material exiting the outlet duct 20. The sample duct 201 includes a valve 202 by which the sample can be commenced or haulted as required. In operation of the largest type machine of the type shown in FIG. 1 which may have an inner bowl of the order of 30 inches in diameter, the operation of the device can be fine tuned by sampling the gangue as it is returned and using a separate device of the same general type to test the sample to return in the presence of any materials in the gangue which should form part of the concentrate. If the separation therefore is not sufficiently efficient, tuning of the operation can be carried out by modifications to various parameters particularly the pressure of the water in the bowl chamber.

Furthermore in FIG. 1, there is provided a donut shaped restrictor 133 in the inlet duct 13. The duct 13 is of a large dimension for example 10 inches diameter in a machine having a bowl of 30 inches diameter. This enables the feed to be dumped into the duct 13 from a supply pipe without contact or coupling between the duct and the supply pipe since any such coupling can cause generation of unacceptable vibrations in the machine. However it has been found that this can lead to overfeeding of the machine with consequent serious reduction in separation efficiency. The donut 133 thus provides a central opening 134 of for example 4 inches in diameter which restricts the flow to the maximum which the machine can accept and in addition centres the flow 10 that it is prevented from entering at one point on the periphery of the duct 13. This evens the layer of material on the interior of the drum.

I claim:

1. Apparatus for centrifugally separating intermixed materials of different specific gravities comprising a centrifuge bowl having a base and a peripheral wall surrounding an axis passing through the base and generally upstanding from the base to an open mouth, axially spaced inwardly projecting peripherally extending members defined on an inner surface of the peripheral wall so as to provide a peripherally extending recess between each member and the next adjacent member, and a plurality of openings extending through the peripheral wall from an outer surface to the inner surface thereof, the openings being arranged in the recess between each member and the next adjacent member and in spaced relation around the peripheral wall, means mounting the bowl for rotation about the axis, means for feeding materials into the bowl such that during rotation of the bowl they flow over the peripheral wall for discharge from the open mouth, and means for applying fluid to the outer surface of the bowl so as to pass through the openings and fluidize the materials in the recesses, each recess being shaped in cross section to define a pair of sidewalls extending generally outwardly from said axis and converging toward an imaginary apex, and a base wall transverse to and interconnecting the sidewalls through which said openings extend, the angle subtended between the sidewalls at the apex being less than 45° and the dimension of the base wall from one sidewall to the other of the sidewalls is greater than the diameter of the openings and greater than ¼ inch.

2. The invention according to claim 1 wherein the angle subtended between the sidewalls is of the order of 30°.

3. The invention according to claim 1 wherein the openings are arranged to pass through the peripheral wall in a direction inclined to an axial plane passing therethrough so as to tend to direct the fluid around the peripheral wall.

4. The invention according to claim 1 wherein the openings are arranged substantially centrally between one sidewall and the opposed sidewall.

5. The invention according to claim 1 wherein one sidewall of a recess and a next adjacent sidewall of a next adjacent recess converge toward the axis and are interconnected by an upper wall transverse to said sidewalls at a position spaced inwardly of said base wall relative to said axis.

6. The invention according to claim 1 wherein said bowl comprises an outer rigid metal support layer having an inner surface which is free from said members and recesses and a cast plastics inner layer having an outer surface lying in contact with and substantially following the shape of the inner surface of the support layer and an inner surface defining said members and said recesses whereby the members and recesses are formed wholly in and by the plastics material.

7. The invention according to claim 6 wherein the plastics inner layer is cast into said outer support layer.

8. The invention according to claim 6 wherein said openings are formed by deformed portions of said outer layer punched in said outer layer and holes drilled through said deformed portions and through said plastics inner layer.

9. The invention according to claim 8 wherein the deformed portions are punched inwardly of said outer layer.

10. Apparatus for centrifugally separating intermixed materials of different specific gravities comprising a centrifuge bowl having a base and a peripheral wall surrounding an axis passing through the base and generally upstanding from the base to an open mouth, and axially spaced inwardly projecting peripherally extending members defined on an inner surface of the peripheral wall so as to provide a peripherally extending recess between each member and the next adjacent member, means mounting the bowl for rotation about the axis, means for feeding materials into the bowl such that during rotation of the bowl they flow over the peripheral wall for discharge from the open mouth, said bowl comprising an outer rigid metal support layer having an inner surface which is free from said members and recesses, said support layer having a plurality of openings formed by deformed portions punched in said support layer and a cast plastics inner layer having an outer surface lying in contact with and following exactly by casting therein the shape of the inner surface of the support layer and an inner surface defining said members and recesses whereby the members and recesses are formed wholly in and by the plastics material, said inner layer having holes therein drilled through said inner layer and through said deformed portions of said support layer.

11. The invention according to claim 10 wherein the deformed portions are punched inwardly of said outer layer.

12. Apparatus for centrifugally separating intermixed materials of different specific gravities comprising a centrifuge bowl having a base and a peripheral wall surrounding an axis passing through the base and generally upstanding from the base to an open mouth, axially spaced inwardly projecting peripherally extending members defined on an inner surface of the peripheral wall so as to provide a peripherally extending recess between each member and the next adjacent member, means mounting the bowl for rotation about the axis, means for feeding materials into the bowl such that during rotation of the bowl they flow over the peripheral wall for discharge from the open mouth, a housing surrounding the open mouth for collecting and confining the material discharged therefrom, said housing defining an annular channel which directs the material to an outlet duct and a liner for said channel which is a unitary integral molding from a wear resistant plastics material.

13. The invention according to claim 12 wherein said liner includes an inner cylindrical wall, outer cylindrical wall co-axial therewith, base wall connecting said inner and outer walls at one end thereof and arranged at an angle to the axis so as to converge toward an outlet in said outer wall, a lip in said outer wall for extending into an outlet of said apparatus, said inner wall including a turned over flange for engaging over an upper edge of an inner support wall and said outer wall including an inwardly turned annular flange for extending along for attachment to a horizontal wall.

14. The invention according to claim 12 wherein said outlet duct includes a sampling outlet connected thereto and having a valve therein whereby a sample of the outlet material can be collected for testing.

15. The invention according to claim 12 wherein said feeding means comprises an inlet duct extending through said open mouth substantially centrally thereof toward said base, said inlet duct having restrictor means defining an opening therethrough of reduced dimension relative to said duct and arranged centrally of said duct.

* * * * *